US007874719B2

(12) United States Patent
Markle et al.

(10) Patent No.: US 7,874,719 B2
(45) Date of Patent: Jan. 25, 2011

(54) MOUNTING ASSEMBLY AND METHOD FOR A DRIVE SYSTEM FOR A MIXER

(75) Inventors: Stephen L Markle, Holley, NY (US); Anthony C Kocienski, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 1063 days.

(21) Appl. No.: 11/448,658

(22) Filed: Jun. 8, 2006

(65) Prior Publication Data

US 2007/0286018 A1 Dec. 13, 2007

(51) Int. Cl.
*B01F 13/08* (2006.01)

(52) U.S. Cl. ..... 366/273; 366/331

(58) Field of Classification Search ..... 366/331, 366/129, 281–284, 242–252, 273; 15/22.1–29
See application file for complete search history.

(56) References Cited

U.S. PATENT DOCUMENTS 2,209,287 A * 7/1940 Simpson ..... 366/296
2,480,366 A * 8/1949 Hewitt ..... 29/221.5
3,299,924 A * 1/1967 Hanschitz ..... 241/282.2
4,738,542 A * 4/1988 Hung ..... 366/244
4,884,245 A * 11/1989 McIntosh et al. ..... 366/279
5,094,542 A 3/1992 Engels et al. ..... 366/282
5,368,390 A * 11/1994 Gambrill et al. ..... 366/273
5,478,149 A * 12/1995 Quigg ..... 366/273
7,172,334 B2 * 2/2007 Chiappetta ..... 366/129
2005/0276158 A1 * 12/2005 Thomas ..... 366/250
2006/0245298 A1 * 11/2006 Jagle ..... 366/244

OTHER PUBLICATIONS

International Preliminary Report, PCT/IB/373, dated Oct. 29, 2007.

* cited by examiner

*Primary Examiner*—Tony G Soohoo
(74) *Attorney, Agent, or Firm*—Baker & Hostetler LLP

(57) ABSTRACT

An improved method and apparatus for mixing is provided that features a drive system that is removable from a bearing housing that supports the impeller shaft in the vessel. Some versions of the system and method use a magnetic drive system having a canister projecting outward from the bearing housing. The drive system has a lower shell that engages with the bearing housing and is quickly releasable and/or detachable to facilitate mounting and dismounting of the drive system from the bearing assembly.

7 Claims, 2 Drawing Sheets

MOUNTING ASSEMBLY AND METHOD FOR A DRIVE SYSTEM FOR A MIXER

FIELD OF THE INVENTION

The present invention pertains generally to mixing devices and mixing methods, and more particularly pertains to mixing devices and methods that utilize a driven impeller shaft that extends into a mixing vessel to mix material therein.

BACKGROUND OF THE INVENTION

Mixing devices and assemblies are in wide use in industry, for example, in the food processing, pharmaceutical, biotechnology, chemical, consumer product manufacturing, and other industries. In these industries, it is often desirable to contain a material to be mixed or agitated such as, for example, a liquid, a slurry, or any other material in a vessel and to impart mixing or agitating energy to the material via a shaft that is driven to rotate and has axially extending impellers that impart force to the material. The impellers often take the form of flat or curved blades.

One recently developed type of such mixer, which is sometimes especially suitable for industries requiring very high sanitary or cleanliness or cleanability conditions, is a so-called magnetically driven mixer arrangement.

In one type of a magnetically driven mixer arrangement, the material to be mixed or agitated is sealed inside a vessel and a bearing housing which supports the impeller shaft is provided adjacent an opening of the vessel. The end of the impeller shaft housing is closed with a domed-shape canister. Inside the canister, the end of the impeller shaft has an inner magnetic rotor, which is typically a rotor or a shaft stub having magnets disposed thereon.

External to the canister, a drive system is provided which has a hollowed out outer magnetic rotor which fits around and over the canister, and also has magnets disposed thereon. The outer magnetic rotor is driven by a motor and gear box with an associated shaft, all external to the canister and to the mixing vessel. Typically, the inner rotor magnets face outwardly towards the canister. Also, typically the outer rotor magnets face inwardly towards the canister. Rotation of the outer magnetic rotor creates a rotating magnetic field that tends to rotate the inner magnetic rotor, thus driving the impeller shaft.

In many magnetically driven mixer systems, it has been a prior practice to semi-permanently affix the drive system to the bearing housing by utilizing radially extending flanges having holes in the flanges combined with bolts through the holes of the associated flanges.

This type of arrangement uses radial flanges and axial bolts and provides good alignment and durability. However, this arrangement also has the disadvantage that it is relatively cumbersome and time consuming to undo all of the bolts in order to remove the motor and drive assembly from the bearing housing. This is especially true since a relatively large number of bolts can be involved. Of course reinstalling the drive system to a vessel also requires a cumbersome and time consuming operation of a fairly large number of bolts.

In the case of most known prior art systems, this has not posed a significant disadvantage, because the only removal of the motor and drive system that occurs would occur during some kind of cleaning or servicing of the bearing housing which does not occur particularly frequently. Also, since the bearing housing is detachable from the opening in the vessel, it has been a suitable practice to detach the bearing housing and motor drive assembly as one single unit.

However, in some instances it would be desirable to have a more readily detachable and re-attachable drive system. Accordingly, there is a need in the art for a mixing impeller drive system and method that provides a convenient, economical and rapid installation and removal of the drive system from the remainder of the mixer assembly.

SUMMARY OF THE INVENTION

The foregoing needs are met, to a great extent, by the present invention, wherein in one aspect an apparatus is provided that in some embodiments provides an improved drive system mounting assembly and method for a mixing device, including in some embodiments a bayonet type mount.

In accordance with one embodiment of the present invention, a mixer drive apparatus having a bearing housing that rotationally supports an impeller shaft; an outer cylindrical surface defined by the bearing housing having a first engaging feature thereon; a removable drive system, having a cylindrical lower shell sized to fit over a portion of the bearing housing; and a second engaging feature on the lower shell that releasably fastens the lower shell to the bearing housing by engaging the first engaging feature.

In accordance with another embodiment of the present invention, a mixer drive apparatus having a bearing housing that rotationally supports an impeller shaft; an outer cylindrical surface defined by the bearing housing having a first engaging means therein; a removable driving means for driving the impeller shaft having a cylindrical lower shell sized to fit over a portion of the bearing housing; and a second engaging means on the lower shell for fastening lower shell to the bearing housing.

In accordance with yet another embodiment of the present invention, a method for mixing material in a vessel having an impeller shaft, the method includes rotationally supporting an impeller shaft with a bearing housing; engaging an outer cylindrical surface defined by the bearing housing having a first engaging feature thereon with a removable drive system, having a cylindrical lower shell sized to fit over a portion of the bearing housing and a second engaging feature on the lower shell that releasably fastens the lower shell to the bearing housing by engaging the first engaging feature by engaging the first and second engaging features with each other.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
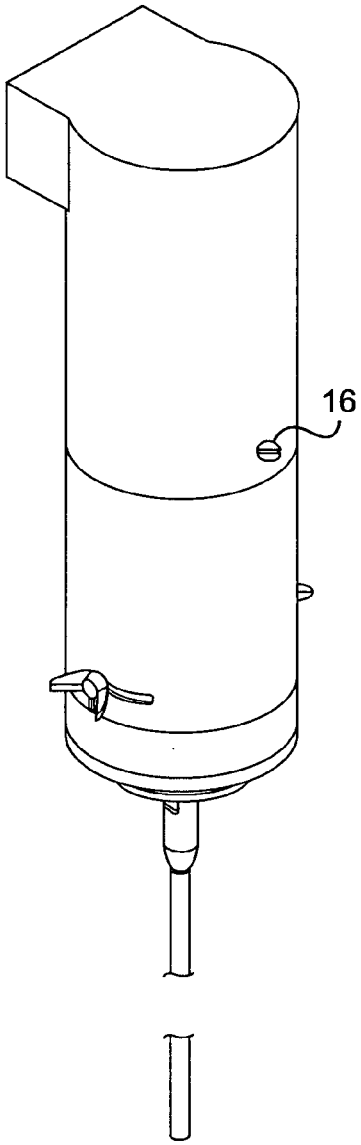
FIG. 1 is a perspective view of a drive assembly, bearing housing, and impeller shaft according to a preferred embodiment of the present invention.

Some embodiments of the present invention provide a mixing impeller drive system and method that provides a convenient, economical and rapid installation and removal of the drive system from the remainder of the mixer assembly. In one example embodiment, a bayonet type mounting arrangement is provided. Preferred embodiments will now be described with reference to the drawing figures, in which like reference numerals refer to like parts throughout.

FIGS. 1 through 4 illustrate a preferred embodiment of the present invention, in which a drive system for a magnetically driven mixer impeller is provided with a quick and convenient detachment with respect to a bearing housing. More specifically, a drive system 10 is shown which includes a motor and gear drive housing including an upper cylindrical shell portion 12 and a lower cylindrical shell portion 14. The upper and lower shell portions 12 and 14 may be two pieces secured by one or more connecting screws 16 or may be a single shell. The upper shell portion 12 surrounds a motor assembly (not shown) and may have a panel 18 for a controller.

The lower end 20 of the lower shell portion 14 extends downwardly as shown. The inner diameter surface of the lower shell portion 14 has an inner diameter sized to fit over a diameter of a cylindrical side surface 22 of the bearing housing 24. The bearing housing 24 supports an impeller shaft 26 as shown. The bearing housing 24 also has a lower end 28 that is sized to be mounted to an opening of a mixing vessel (not shown) in FIGS. 1 and 2. The bearing housing 24 also has an upwardly (away from the vessel) protruding canister 30 which is mounted to the bearing housing by a series axially directed screws 32.

Figure 2:
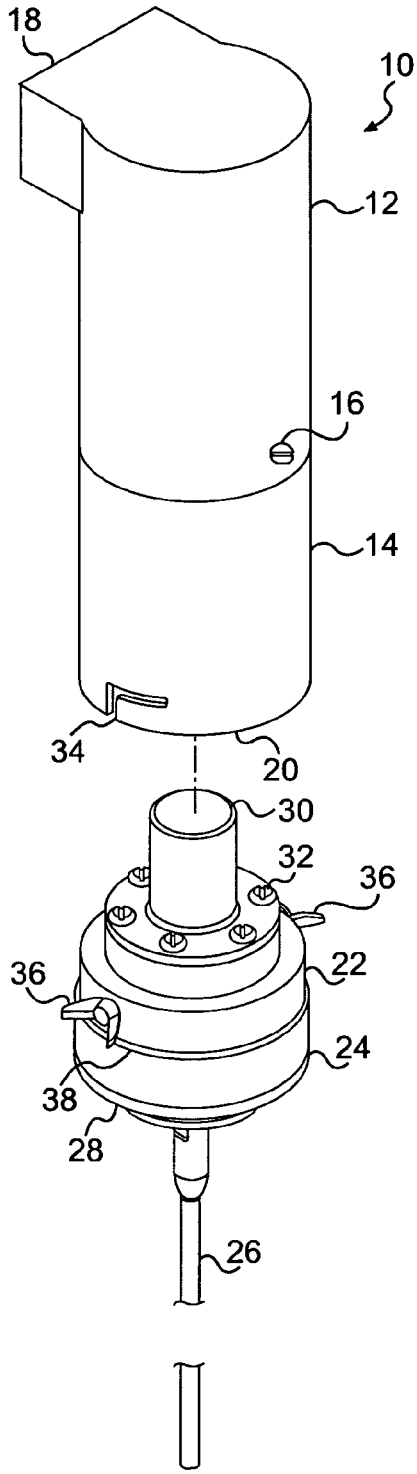
FIG. 2 is an exploded view of the assembly of FIG. 1.
Figure 3:
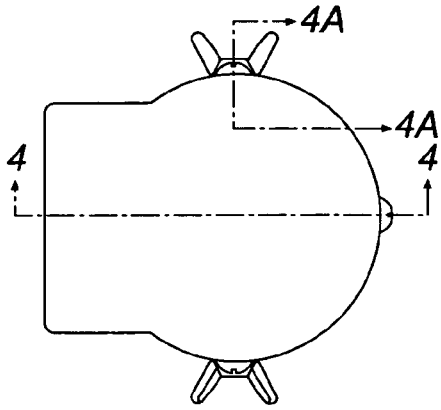
FIG. 3 is a top view of the assembly of FIG. 1.

FIG. 2 shows the assembly in the disassembled state. To assemble the device into the operative configuration shown in FIG. 1, the lower shell portion 14 is lowered over the surface 22 with the vertical part of an L-shaped slot 34 aligned with the threaded shaft of a wing screw 36. The wing screw 36 is screwed into a threaded hole in the surface 22 of the bearing housing 24. The vertical slot portion of the L-shaped slot 34 is slightly wider than the threaded portion of the wing screw 36 so that the lower shell portion 14 can slide down and over the surface 22 until the bottom end surface 20 will bottom out against a shoulder 38 on the bearing housing 24. Next, the lower shell portion 14 is rotated clockwise so that the threaded shaft of the wing screw 36 slides along the horizontal portion of the L-shaped slot 34, thus, positively locating the bottom end 20 against the shoulder 38.

The horizontal portion of the L-shaped slot 34 may be slightly angled or tapered so that it tends to cam against the threaded surface of the wing screw 36, forcing the lower shell portion 14 downward and further contributing to the bottom end 20 bottoming out on the shoulder 38. Once the lower end 20 is fully bottomed out on the shoulder 38, the wing screw 36 is tightened, thereby securing the entire assembly in place.

In the preferred embodiment illustrated, two opposed wing screws 36 are provided, but any other number may be used. Typically to or more wing screws 36 will be provided, but, for example, if close alignment is not required, or if other alignment features are used, some embodiments may have solely one wing screw.

Also, although a wing screw is illustrated, it will be appreciated that any other type of tightenable fastener, such as, for example, an allen head screw, Philips head screw, a machine head screw, or other like fasteners can be used to engage the L-shaped slot 34 and also to tighten against it. Also, in some embodiments, instead of a removable screw, a fixed radially protruding post may be provided which interacts with the L-shaped slot 34. Further, although an L-shaped slot is depicted having a generally vertical axial leg portion meeting at substantially right angles with a generally horizontal portion (which might be slightly tapered or tilted to provide a tightening effect) it will be appreciated that other shapes of keyways can be utilized in place of the L-shaped slot 34, and in particular, may be shaped and designed to operatively correspond with the fixed post or removable fastener 36 being used.

Also a combination of one or more screws or posts may be used. Also, the slots and screws/posts can be reversed so the slots are on the surface 22 and the screws/posts extend inward from the lower shell portion 14. Besides slots and screws/posts, any other interlocking mechanical connection can be employed, including threads or mating keyways. Generally, all of these mechanical attachments include various bayonet mounts.

Figure 4:
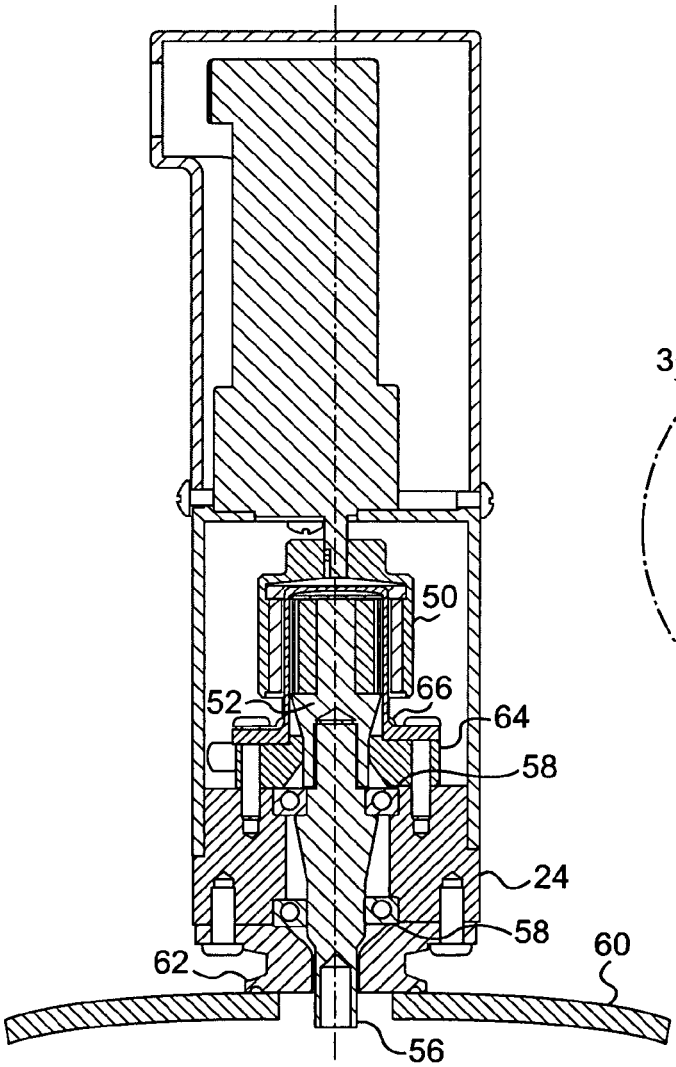
FIG. 4 is a cross-sectional view taken through line 4-4 of FIG. 3.

FIG. 4 is an exploded view, which shows further details, particularly of the magnetic connection. In addition to the elements described above, FIG. 4 also depicts an outer magnetic rotor 50 which has magnets disposed on its inward surface, and the inner magnetic rotor 52 which has magnets disposed around its outer surface. The inner magnetic rotor 52 is shown mounted to an impeller shaft 56 which is supported by a pair of roller bearings 58. In some preferred embodiments, these roller bearings 58 may be of an all-ceramic design, or can be a metal or metal ceramic design.

FIG. 4 also illustrates a vessel 60 to which the bearing housing 24 is mounted. The connection of the bearing housing 24 to the vessel 60 in this figure is schematic only and may be accomplished by any suitable known attachment method. In addition, the illustrated embodiment shows the bearing housing 24 including a pedestal 62 by which it is mounted to the vessel 60 and also having a upper pedestal 64 which is mounted to the bearing housing 24 in supports the canister dome 30. This type of bearing housing is illustrated by way of example only.

Figure 4A:
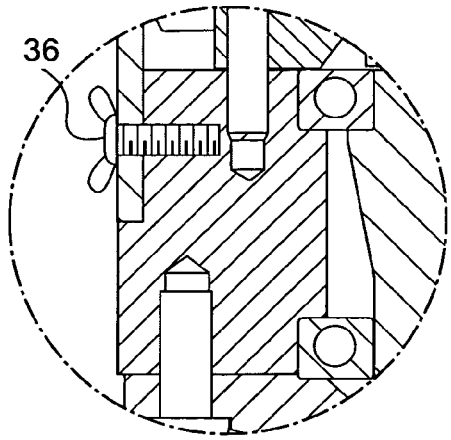
FIG. 4A is a detail cross-section view taken through line 4A-4A of FIG. 3.

FIG. 4A shows the interaction of the wing screws 36 projecting into threaded bores in the bearing housing 24.

Some embodiments according to the present invention can be utilized wherever it is desirable to have a quick release drive system for a mixer including, for example, magnetically driven mixers. They may also be usable in other applications other than magnetic mixers, for example, where instead of a magnetic canister and inner and outer magnetic rotors, a simple splined or other axial end-to-end shaft connection may be implemented.

However, one particularly advantageous use of the above-described embodiment is in the context of sanitary and/or clean-in-place magnetically driven mixers. In some embodiments, sanitary and/or clean-in-place magnetically driven mixers may be completely sealed and may even be disposable. Such mixers may be completely sealed at the time of manufacture, and once filled and used for a mixing cycle and then emptied, some sealed magnetic mixers vessels may be disposable.

In these systems, a particularly advantageous manufacturing process can be implemented wherein a manufacturing facility may utilize one or a limited number of drive systems which is less than a number of vessels that are used in the manufacturing facility. That is, the drive systems can be quickly changed from one vessel to another.

Also, in the case of disposable vessels, or vessels that are taken off site for cleaning or refurbishment, a useful arrangement can be obtained where (1) the vessels are delivered without a drive system, (2) a drive system which is already at the facility is quickly mounted onto the vessel, (3) the mixing cycle is performed, and then (4) the drive system can be quickly removed. In another embodiment of the invention, standard sizes of canisters and bearing housing can be developed over a range of different standard sizes, and corresponding standard size lower shells 14 can also be designed, so that a system is provided having a number of different user selectable corresponding standard sizes.

In the illustrated embodiment, the lower end 20 of the lower shell portion 14 provides a positive bottoming out stop facing against the shoulder 38. This provides an advantage of these embodiments, wherein a positive axial placement as well as axial alignment is provided by the interface of these two surfaces. This facilitates alignment of the inner and outer magnetic rotors and proper drive operation. However, in other embodiments, other alignment contact surfaces may be provided and besides being a flat bottom end 20.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mixer drive apparatus for rotating an impeller, the apparatus comprising:

a motor housing;

a motor secured within the motor housing, the motor including an output shaft;

a magnetic coupling comprising a first magnetic coupling portion and a second magnetic coupling portion, the first magnetic coupling portion being secured to the output shaft in alignment with a central axis of the output shaft, the impeller being secured to the second magnetic coupling;

a bearing housing;

a bearing secured within the bearing housing, the second magnetic coupling portion being rotationally secured along a central axis of the bearing; and a fastener to releasably fasten the bearing housing to the motor housing, the fastener comprising:

an L-shaped slot disposed within the motor housing; and a threaded wing screw configured to mate with a threaded bore disposed in the bearing housing, the threaded wing screw extending radially outwardly from the bearing housing, the threaded wing screw being configured to releasably engage the L-shaped slot, wherein rotation of the threaded wing screw in a first direction is configured to fasten the motor housing to the bearing housing and rotation of the threaded wing screw in a second direction is configured to facilitate release of the motor housing from the bearing housing, wherein the first magnetic coupling portion and the second magnetic coupling portion are magnetically coupled in response to the bearing housing being fastened to the motor housing and the first magnetic coupling portion being configured to urge the second magnetic coupling portion to rotate in response to rotation of the first magnetic coupling portion, wherein the first magnetic coupling portion is magnetically decoupled from the second magnetic coupling portion in response to the motor housing being removed from the bearing housing.

2. The apparatus according to claim 1, further comprising a second fastener.

3. The apparatus according to claim 1, wherein the bearing housing has a circumferential seating shoulder, and wherein the motor housing has a lower end adapted to seat onto the shoulder.

4. A mixer drive apparatus for rotating an impeller, the apparatus comprising:

a motor housing;

a motor secured within the motor housing, the motor including an output shaft;

a magnetic coupling comprising a first magnetic coupling portion and a second magnetic coupling portion, the first magnetic coupling portion being secured to the output shaft in alignment with a central axis of the output shaft;

a bearing housing;

a bearing secured within the bearing housing;

a bearing spindle rotationally secured along a central axis of the bearing, the bearing spindle having a first spindle end and a second spindle end, the second magnetic coupling portion being secured to the first spindle end along a central axis of the bearing spindle, the second spindle end including a coupling to receive a shaft of the impeller; and a fastener to releasably fasten the bearing housing to the motor housing, the fastener comprising:

an L-shaped slot disposed within the motor housing; and a threaded wing screw configured to mate with a threaded bore disposed in the bearing housing, the threaded wing screw extending radially outwardly from the bearing housing, the threaded wing screw being configured to releasably engage the L-shaped slot, wherein rotation of the threaded wing screw in a first direction is configured to fasten the motor housing to the bearing housing and rotation of the threaded wing screw in a second direction is configured to facilitate release of the motor housing from the bearing housing, wherein the first magnetic coupling portion and the second magnetic coupling portion are magnetically coupled in response to the bearing housing being fastened to the motor housing and the first magnetic coupling portion being configured to urge the second magnetic coupling portion to rotate in response to rotation of the first magnetic coupling portion, wherein the first magnetic coupling portion is magnetically decoupled from the second magnetic coupling portion in response to the motor housing being removed from the bearing housing.

5. The apparatus according to claim 4, further comprising a second fastener.

6. The apparatus according to claim 4, wherein the bearing housing has a circumferential seating shoulder, and wherein the motor housing has a lower end adapted to seat onto the shoulder.

7. A method for mixing material in a vessel having an impeller secured to an impeller shaft, the method comprising:

fastening a bearing housing to vessel, the bearing housing having a bearing spindle affixed to the impeller shaft; and magnetically coupling an output shaft of a motor disposed in a motor housing to the bearing spindle by releasably fastening the motor housing to the bearing housing, wherein the motor housing is releasably fastened to the bearing housing by:

aligning an opening of an L-shaped slot disposed in the motor housing with a threaded wing screw extending radially outwardly from the bearing housing;

axially sliding the motor housing relatively towards the bearing housing to engage the threaded wing screw with the L-shaped slot;

rotationally sliding the motor housing relative to the bearing housing to further engage the threaded wing screw with the L-shaped slot; and rotating the threaded wing screw in a first direction to fasten the motor housing to the bearing housing;

energizing the motor to urge the impeller to rotate via the magnetic coupling, the material being mixed in response to the rotating the impeller;

de-energizing the motor to stop urging the impeller to rotate via the magnetic coupling; and magnetically de-coupling the output shaft from the bearing spindle by removing the motor housing from the bearing housing, wherein the motor housing is removed from the bearing housing by:

rotating the threaded wing screw in a second direction to unfasten the motor housing to the bearing housing;

rotationally sliding the motor housing relative to the bearing housing to align the threaded wing screw with the L-shaped slot; and axially sliding the motor housing relatively away from the bearing housing to remove the motor housing from the be in housing.

* * * * *